United States Patent [19]

Key et al.

[11] Patent Number: 4,698,038

[45] Date of Patent: Oct. 6, 1987

[54] VESSEL MOORING SYSTEM AND METHOD FOR ITS INSTALLATION

[75] Inventors: Joe W. Key, Magnolia; Fred E. Shumaker, Houston, both of Tex.

[73] Assignee: Key Ocean Services, Inc., Magnolia, Tex.

[21] Appl. No.: 661,690

[22] Filed: Oct. 17, 1984

[51] Int. Cl.[4] ..... E21B 43/01

[52] U.S. Cl. ..... 441/5; 114/264; 405/202; 166/355

[58] Field of Search ..... 441/3, 5, 133; 114/264, 114/230, 144 B, 293; 405/202; 166/355, 356, 350; 175/7

[56] References Cited

U.S. PATENT DOCUMENTS

| | | | |
|---|---|---|---|
| 3,189,098 | 6/1965 | Haeber | 166/355 |
| 3,196,958 | 7/1965 | Travers | 166/355 |
| 3,525,312 | 8/1970 | Beck | 441/5 |
| 3,602,302 | 8/1971 | Kluth | 114/264 |
| 3,605,668 | 7/1969 | Morgan | 441/3 |
| 3,620,181 | 11/1971 | Naczkowski | 441/3 |
| 3,722,584 | 3/1973 | Nelson | 166/355 |
| 4,042,990 | 8/1977 | Donaldson | 114/230 |
| 4,321,720 | 3/1982 | Havre | 441/5 |
| 4,446,807 | 5/1984 | Johnson | 114/230 |
| 4,571,125 | 2/1986 | Oshima et al. | 405/224 |

FOREIGN PATENT DOCUMENTS

| | | | |
|---|---|---|---|
| 1014879 | 12/1965 | United Kingdom | 114/230 |
| 1189758 | 4/1970 | United Kingdom | 114/230 |
| 1595045 | 8/1981 | United Kingdom | 21/50 |

*Primary Examiner*—Joseph F. Peters, Jr.
*Assistant Examiner*—Clifford T. Bartz
*Attorney, Agent, or Firm*—Steve Rosenblatt

[57] ABSTRACT

The present invention provides a vessel mounted mooring system and a method for its installation. The method involves the construction of a vertical well in the vessel extending from the deck to the bottom plates. A lower bearing ring which circumscribes the well is connected to the underside of the bottom plates and extends beyond the keel. A lower turret unit is supported substantially within the bearing ring. A middle turret unit is placed into the well and connected to the lower turret unit. An upper bearing ring which circumscribes the well is mounted to the deck. An upper turret unit is connected to the middle turret unit whereupon the assembly of the upper, middle and lower turret units is supported and guided by the upper bearing ring and further guided by the lower bearing ring. Chain lockers which include chains and windlasses are mounted to the upper turret unit for selectively paying out or reeling in chain through the upper, middle and lower turret unit to allow the chain to be connected near the subsea floor.

17 Claims, 5 Drawing Figures

VESSEL MOORING SYSTEM AND METHOD FOR ITS INSTALLATION

FIELD OF THE INVENTION

This invention relates to a mooring apparatus for installation and use aboard a vessel.

BACKGROUND OF THE INVENTION

The offshore production of oil at substantial distances from land or in remote areas often makes it impractical to install a pipeline on the sea floor so that the oil produced from the offshore wells can be pumped directly to shore for storage and/or further transportation or processing. Oil produced under such circumstances is more conveniently delivered directly or by short feeder pipelines to a moored dedicated vessel, such as an oil tanker where it can be stored until transhipment. Mooring a vessel offshore for extended periods presents many problems, including anticipated storm conditions at the mooring location. It is desirable for mooring systems to permit the vessel to weathervane so that the vessel will always face into prevailing seas, current and wind. Because of anticipated storm conditions at potential mooring sites, it is generally not suitable to use conventional ship anchors and mooring lines for long term mooring because of the large size which would be required. A more suitable mooring system for an offshore vessel which permits it to weathervane, employs a pivoting assembly built into the vessel to allow for collection of oil/gas while the vessel is moved about or weathervanes (i.e. rotates).

In mooring vessels offshore it is important to keep a very accurate station. The importance of keeping an accurate station with respect to the ocean's floor is obvious when consideration is given to offshore drilling and the requirement that the drilling string, for example should be relatively stationary against ocean caused shear forces at all times. Production of hydrocarbons from subsea wells also requires a stationary point on the production vessel to avoid undue extension of the flexible riser lines.

The change in heading which is often required by weathervaning is also problematical in that it is difficult to accomplish with conventional, multiple anchor mooring systems because anchor chains must be taken in and paid out to accommodate the change in vessel heading.

Because of the difficulties in changing the vessel heading with multiple anchor mooring systems, known mooring systems employ a centrally mounted swivel which extends completely through the ship from the deck through to the bottom of the vessel. The mooring chains extend through the swivel. When a heading change is required the vessel is effectively rotated about the mooring swivel to a desired heading, the swivel being stationary with respect to the mooring anchors and ocean floor. Typical of such mooring systems are U.S. Pat. Nos. 3,279,404; 3,602,175; 3,440,671; 3,552,343; 3,620,181; 3,605,668; 3,590,407; 3,279,404; and 3,774,562.

Onboard mooring systems have traditionally featured a large well extending from the deck through the bottom of the ship. Due to the size of the opening, the structure of the ship must be specifically engineered to accommodate the size of the opening. In attempting to install an onboard turret mooring system into an existing vessel, the size of the well is so large that the structure of each specific vessel must be analyzed prior to construction. The necessity of the extended engineering and design effort required to retrofit an existing tanker with a large central well may create unacceptable costs and delays in the final delivery of the tanker. Extensive engineering and design effort is required since the openings through the deck and the bottom plating must be very large, in the order of thirty to sixty feet in diameter, to properly transmit the mooring loads into the ship's structure. The presence of such a large opening in the hull adversely effects the longitudinal hull strength of the tanker and often requires significant modifications to achieve the proper desired strength required by regulatory agencies. Additionally, the significant delays encountered due to the engineering and design effort required may sometimes result in the tanker for which the design has been created becoming unavailable. In those situations, the entire design effort is wasted since it was especially tailored for a ship of a particular design.

Since a turret design must be developed with a particular ship in mind, one universal design incorporating several compromises may create significant limitations in flexibility to adapt various mooring line diameters and quantities/size of risers unless the standard unit design is overdesigned for the worst conceivable case. Finally, since a turret mooring system must be specially designed for each ship, firm quotations cannot be obtained from shipyards at the early stage of a project due to the uncertainty about the existing ship's hull structure and how the mooring system will effect such a structure.

Accordingly, the apparatus and method of the present invention address the need for a family of several specific designs which are adaptable for any barge, tanker, drill ship, semi-submersible unit or LNG/LPG carrier for the environmental conditions to be encountered. This family of designs could have a wide range of applicability to various size tankers, such as 50,000 DWT to 300,000 DWT, for example and for service in diverse environmental conditions, such as wave heights of thirty to ninety feet, for example and for a multitude of water depths, such as one hundred to three thousand feet, for example. This family of designs would be suitable for numerous types of vessels such as oil storage barges, existing or proposed drill ships and floating process plants, among others.

SUMMARY OF THE INVENTION

A family of designs which is adapted for retrofitting into existing or newly constructed vessels without substantial structural redesign includes a relatively slender central section or middle turret unit which can be inserted through a small hole through the main deck. The middle turret unit of the present invention is closer to ten feet in diameter as compared to prior designs which ranged from thirty to sixty feet in diameter and above. Accordingly, a family of designs suitable for retrofitting into existing vessels which requires only a small hole through the vessel, can be finally designed, model tested, and fabricated before it is known specifically in which vessel the mooring system will be installed. Repetitive engineering and model testing costs and lead time for achieving actual production from a new discovery can be minimized due to the reduced construction time.

The present invention provides a vessel mounted mooring system and a method for its instalation. The method involves the construction of a vertical well in the vessel extending from the deck through the bottom plates of the vessel. A lower bearing ring which circumscribes the well is connected to the underside of the bottom plates. A lower turret unit is supported substantially within the lower bearing ring. A middle turret unit is placed into the well and connected to the lower turret unit. An upper bearing ring which circumscribes the well is mounted to the deck. The upper turret unit is connected to the middle turret unit whereupon the assembly of the upper, middle and lower turret units is supported and guided by the upper bearing ring and further guided by the lower bearing ring. Chain lockers which include chains and windlasses are mounted to the upper turret unit for selectively paying out or reeling in chain through the upper, middle and lower turret unit to allow the chain to be connected near the subsea floor.

DETAILED DESCRIPTION OF THE PREFERRED EMBODIMENT

Figure 1:
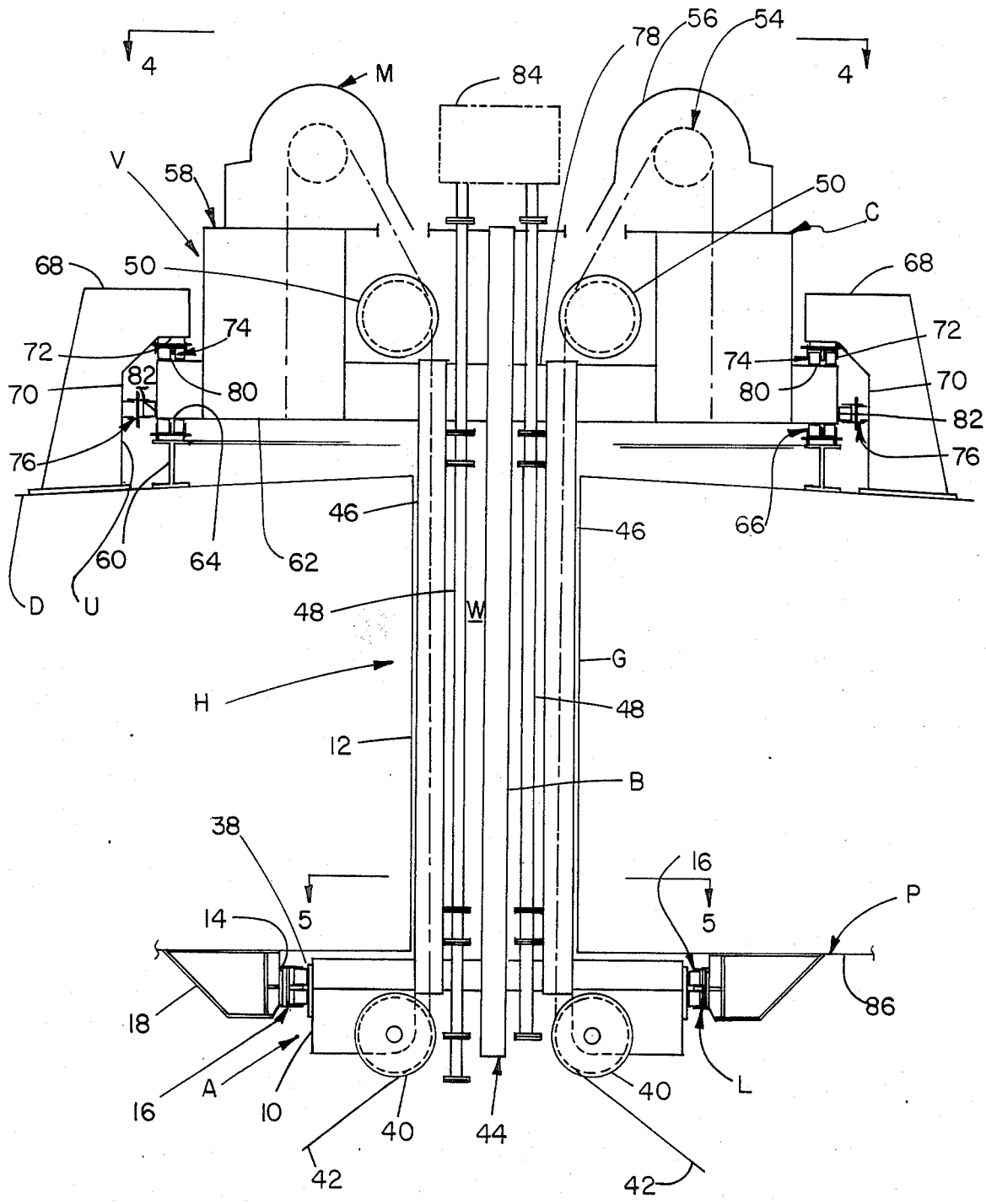
FIG. 1 is a sectional elevational view taken through the center line of the well of the vessel.

In the preferred embodiment, the mooring system H and the method for its installation are illustrated in FIG. 1. FIG. 1 illustrates a sectional view through a vessel V having a deck D and bottom plates P. The bottom plates P extend in a known fashion to the lower most portion of the vessel. The apparatus of the present invention fits through an opening in the deck D and an opening in bottom plates P. A series of bulkheads G define a substantially vertical opening or well W extending from deck D to bottom plates P.

The mooring system H includes a lower turret unit A, a middle turret unit B and an upper turret unit C. The mooring system H of the present invention further includes a lower bearing ring L and an upper bearing ring U. Mooring means M is connected to upper turret unit C for reeling in and paying out mooring chain or cable 42 through mooring system H as will be further described hereinbelow.

As seen in FIG. 1, lower turret unit A is fabricated from structural steel components and has an annular shape. Lower turret unit A has an arcuate outer surface 10 whose diameter greatly exceeds that of well W. Lower turret unit A further includes a central opening 44 of approximately the same cross-sectional area as well W and is substantially aligned therewith. Lower turret unit A further includes a plurality of idler pulleys 40 (FIGS. 1 and 5) to accommodate each mooring line 42 as it passes through the lower turret unit A. The idler pulleys 40 are disposed along the circumference of opening 44 with each pulley adjacent to an end of a chain pipe 46.

Although well W may have a rectangular or square cross-section, a circular outer surface 12 can be provided for well W without departing from the spirit of the invention. Lower bearing ring L has an arcuate bearing surface 14 whose diameter is greater than that of outer surface 10.

Figure 3:
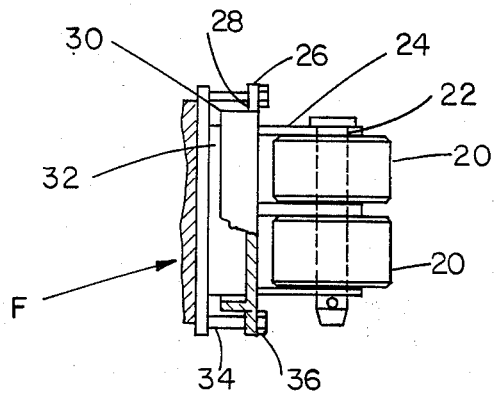
FIG. 3 is a detailed view of the rollers as shown in FIG. 1.

As seen in FIGS. 1 and 3, lower bearing ring L has a plurality of lower roller assemblies 16 disposed at fixed intervals and resiliently mounted to arcuate bearing surface 14. Arcuate bearing surface 14 is held firmly in place and prevented from warping by suitable structural support members 18 connected to bottom plates P adjacent the bottom of the vessel V. A detail of the resilient mounting of lower roller assemblies 16 is shown in FIG. 3. Each lower roller assembly 16 consists of a pair of rollers 20 each held on a common axle 22. A suitable frame 24 supports axle 22 off of mounting plate 26. The back side 28 of mounting plate 26 further includes an open ended housing 30 having a rectangular, square or circular cross-section. In the case of lower roller assembly 16, arcuate bearing surface 14 serves as the fixed surface F to which a resilient member 32 is secured. A plurality of bolts 34 extend through mounting plate 26 and into arcuate bearing surface 14, in the case of lower roller assemblies 16. The heads 36 of bolts 34 serve as a radial travel limit for the roller assembly 16. In the opposite direction, resilient member 32 absorbs the shocks imparted onto rollers 20 by the lower turret unit A. A lock nut (not shown) may also be secured to each bolt 34 to prevent bolt 34 from unthreading from a fixed surface F such as arcuate bearing surface 14 in the case of lower roller assembly 16. Each pair of rollers of roller assembly 16 may be circumferentially disposed at three to five degree intervals along fixed surface F, for example.

Resiliently mounted lower roller assembly 16 rides upon wearing surface 38, said wearing surface 38 is mounted to lower turret unit A.

Middle turret unit B consists of an assembly of chain pipes 46 with each mooring line 42 extending through a chain pipe 46. Middle turret unit B further includes at least one riser pipe 48. The riser pipes 48 are disposed substantially parallel to chain pipes 46 in middle turret unit B. Middle turret unit B is disposed substantially within well W and extends from lower turret unit A to upper turret unit C. Middle turret unit B is firmly attached to lower turret unit A adjacent bottom plates P of vessel V. Chain pipes 46 and riser pipes 48 extend from lower turret unit A through middle turret unit B to upper turret unit C in a direction substantially parallel to the longitudinal axis of well W.

The middle turret unit B is connected to upper turret unit C adjacent deck D. Upper turret unit C is a fabricated annular structure having an outside dimension larger than the well W. Upper turret unit C has a central opening 79 (FIG. 4) about the same size as well W and aligned therewith. A circular structural support member 60 (FIG. 1) is connected to deck D and circumscribes the opening in deck D made by well W. The underside 62 of upper turret unit C has a circular wearplate 64 in substantial alignment with circular structural support member 60. Thrust rollers 66 are resiliently mounted at spaced intervals to circular structural support member 60. The mounting detail of thrust rollers 66 is shown in FIG. 3. In this instance, the fixed surface F represented in FIG. 3 corresponds to circular structural support member 60. Thrust rollers 66 may be distributed at intervals of three to five degrees along circular structural support member 60, however other intervals may be used without departing from the spirit of the invention.

Upper bearing ring U, apart from including circular support members 60 and thrust rollers 66, further includes a plurality of individual pillars 68 circumferentially disposed about well W and each pillar 68 located adjacent to a thrust roller assembly 66. Each pillar 68 is substantially L-shaped and has a vertical inside bearing surface 70 and a horizontal downwardly facing bearing surface 72. Accordingly, the assembly of pillars 68 each including a vertical bearing surface 70 and a horizontal bearing surface 72 constitute a roller support structure for uplift roller assembly 74 and lateral roller assembly 76. Uplift roller assembly 74 consists of a plurality of resiliently mounted rollers each connected to horizontal bearing surface 72 of a pillar 68. As such, each pair of rollers constituting roller assembly 74 are constructed in a way shown in FIG. 3 and resiliently mounted to horizontal bearing surface 72 in the manner shown in FIG. 3. Each pair of rollers of uplift roller assembly 74 is disposed over a pair of rollers constituting thrust roller assembly 66. The upper surface 78 of upper turret unit C includes a bearing plate 80 having a substantially circular cross-section. Uplift roller assembly 74 bears against bearing plate 80 connected to upper turret unit C.

Each pillar 68 has a vertical bearing surface 70 onto which lateral roller assembly 76 is secured. Lateral roller assembly 76 consists of a single roller resiliently mounted to each vertical bearing surface 70 in the manner shown in FIG. 3. Although a single lateral roller is shown connected to each vertical bearing surface, it is understood that a plurality of rollers having a common axle can also be employed without departing from the spirit of the invention. Lateral roller assembly 76 bears against a bearing plate 82 on upper turret unit C. Pillars 68, mounted to deck D, may be disposed at intervals of six to eight degrees circumscribing well W although a different spacing may be employed without departing from the spirit of the invention.

Mooring means M located above upper turret unit C can pay out and reel in mooring line 42 over idler rollers 50, through chain pipes 46, and over idler pulleys 40, thereby allowing the vessel V to be secured to the subsea floor using mooring lines 42.

Figure 2:
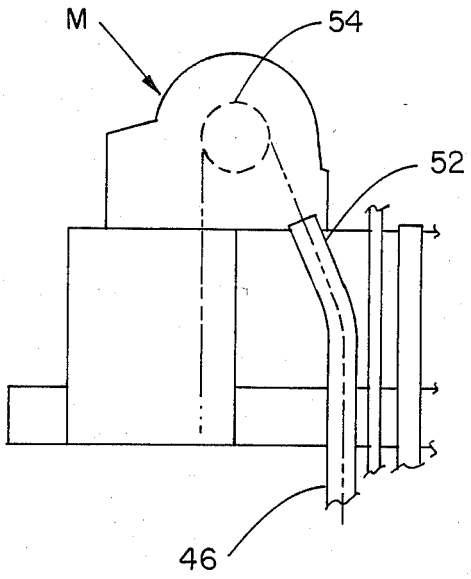
FIG. 2 is an alternative embodiment of the chain payout system shown in a partial sectional elevational view.
Figure 4:
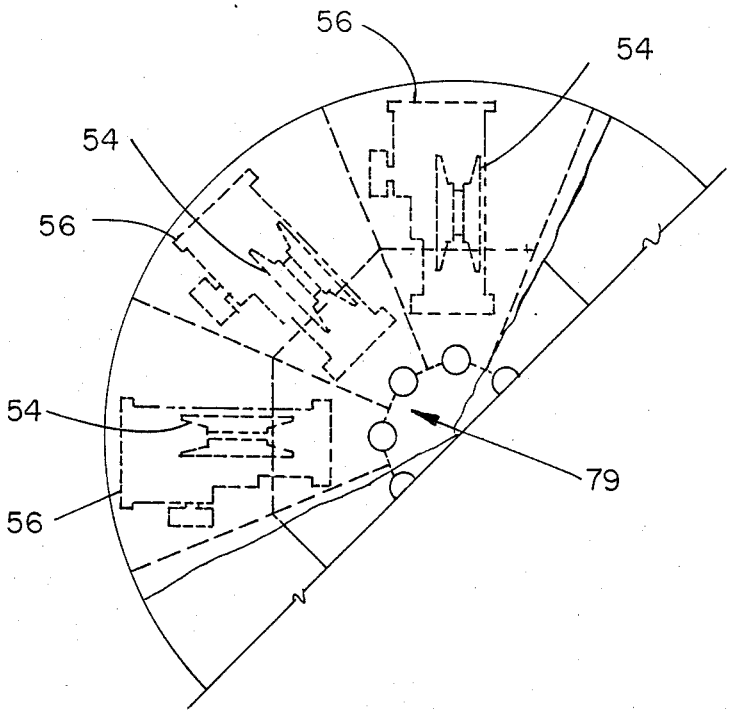
FIG. 4 is a partially cut away plan view taken along lines 4—4 of FIG. 1.

Alternatively, as shown in FIG. 2, idler rollers 50 may be eliminated and chain pipes 46 may contain a bent section 52 which has a longitudinal axis oriented to a tangent line of a pulley 54 which forms part of mooring means M. As shown in FIG. 4, a suitable drive 56 is employed for reeling in and paying out each mooring line 42. Drive 56 includes a mechanism (not shown) for accumulating and paying out mooring line as needed. The mooring line extends from drive 56 over pulley 54 and then through chain pipes 46 as shown in FIGS. 1 or 2. The hydraulic system located onboard a vessel (not shown) can be used to operate drives 56 or some alternative power source may be employed. As shown in FIG. 1, each chain locker 58 supports a drive 56 along with a pulley 54 and accumulated mooring line 42, as needed.

Figure 5:
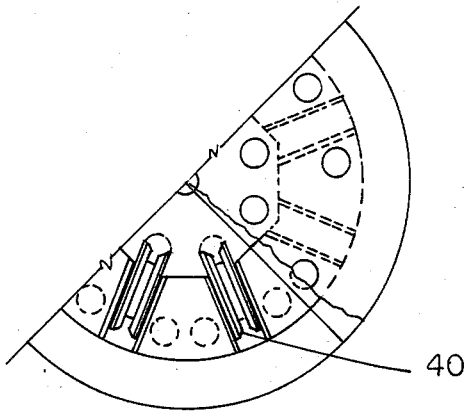
FIG. 5 is a partially cut away plan taken along lines 5—5 of FIG. 1.

Accordingly, when the assembly of the lower turret unit A, middle turret unit B, and upper turret unit C is connected to vessel V in the manner shown in FIG. 1, the vessel V is free to weathervane about the center line of well W in response to weather conditions and tidal forces. Essentially, lower turret unit A, middle turret unit B and upper turret unit C remain stationary while vessel V rotates about the vertical center line of well W. The forces transmitted to the mooring system H comprising of lower, middle and upper segments A, B and C, respectively, due to winds, waves, currents and other weather conditions including tidal action, are transmitted through mooring lines 42 which are secured to the sea floor in substantially a circular pattern having the center line of well W as its center. The forces imparted through mooring lines 42 are transmitted to lower roller assembly 16, thrust roller assembly 66, uplift roller assembly 74 and lateral roller assembly 76. Lower roller assembly 16 resists lateral forces exerted by mooring lines 42 on lower turret unit A in a direction substantially perpendicular to the longitudinal center line of well W. Similarly, lateral roller assembly 76 resists forces exerted by mooring lines 42 on upper turret unit C in a direction substantially perpendicular to the longitudinal center line of well W. Wave action and other circumstances can create uplift forces on upper turret unit C which are resisted by uplift roller assembly 74. Uplift roller assembly 74 resists forces on upper turret unit C extending in a direction from bottom plates P towards deck D and which are further substantially parallel to the longitudinal center line of well W while thrust roller assembly 66 resists forces on mooring assembly H exerted in the opposite direction. As seen in FIGS. 1 and 5, idler pulleys 40 transmit forces from mooring lines 42 to lower turret unit A.

When the mooring system H of the present invention is in place and mooring lines 42 are connected to the subsea floor below vessel V, the assembly of lower turret unit A, middle turret unit B and upper turret unit C is essentially stationary in a lateral direction with respect to the subsea floor. The vessel V is free to weathervane about the center line of well W. The restraint against lateral movement and further the limitation of motion in the vertical direction is necessary in that riser pipes 48 are connected to subsea well completions for production therefrom. These subsea connecting lines, (not shown) have only a limited degree of flexibility and slack. Therefore, it is essential to maintain the station of the vessel with respect to the subsea well site.

The well fluids which are produced from the subsea wells and directed to riser pipes 48 via subsea production lines (not shown), operate at relatively high pressures. A swivel joint as is known in the art 84 is mounted at the upper end of riser pipes 48 and allows a hard pipe connection between essentially stationary riser pipes 48 and moving deck D. It is advantageous to locate the swivel joint above upper turret unit C rather than on the top of buoys as in the past, in that a greater degree of ease is afforded if maintenance is required to swivel joint 84. Furthermore, due to the high pressures involved in production from subsea wells, systems incorporating several production lines will require extremely heavy swivel joints which may limit the practicality of using buoys for connection onto a production ship.

In installing the mooring system H of the present invention into a vessel or barge having a well W extending from the deck D to the bottom plates P, the lower bearing ring L is connected to the underside 86 of bottom plates P. The lower bearing ring L is positioned so that it circumscribes the well and extends beyond the bottom plates. The lower turret unit A is then placed into position substantially within the lower bearing ring L. The middle turret unit B is placed substantially within the well W and connected to lower turret unit A.

Circular structural support member 60 is connected to deck D. Thrust roller assembly 66 is resiliently mounted to circular structural support member 60. Upper turret unit C is lowered onto thrust roller assembly 66 and connected to middle turret unit B. Pillars 68 including lateral roller assembly 76 and uplift roller assembly 74 are connected to deck D in a manner allowing contact between uplift roller assembly 74, lateral roller assembly 76 and upper turret unit C. Mooring means M, including chain lockers 58 each including drives 56 for each mooring line 42, is connected to upper turret unit C. Swivel joint 84 is placed above riser pipes 48 in fluid communication therewith to permit hard piping between essentially stationary risers 48 and moving deck D. Lower turret unit A may have be to temporarily supported substantially within lower bearing ring L until middle and upper turret units B and C, respectively can be connected thereto so that the assembly of the entire mooring system H bears upon thrust rollers 66 of upper bearing ring U.

Mounting lower bearing ring L below bottom plates P and mounting upper bearing ring U above the deck D permits the employment of a relatively small well W to be built into vessel V. At the same time relatively large diameter bearings can be used for lower roller assembly 16, thrust roller assembly 66, uplift roller assembly 74 and lateral roller assembly 76. By incorporating a relatively small well W which for example may be as small as ten feet in diameter as compared to 30 to 60 feet in known designs, the mooring system H can be simply retrofitted into existing vessels without the need for substantial structural analysis, and/or redesign. Frequently, timing is critical in retrofitting existing vessels and if a substantial redesign is required, the viability of the entire project may be in question. The mooring system H of the present invention allows shipyards to quickly give firm quotations for retrofits in that a substantial redesign or structural evaluation of the vessel to be retrofitted is not necessary in view of the relatively small size of well W. Furthermore, by locating lower bearing ring L on the underside of bottom plates P, lower roller assembly 16 is easily accessible to divers to make any necessary repairs. By employment of prefabrication techniques, the actual retrofit time for a particular vessel is greatly reduced in that the extent of the dry-dock work in view of the small opening required for well W is greatly reduced.

The foregoing disclosure and description of the invention are illustrative and explanatory thereof, and various changes in the size, shape and materials, as well as in the details of the illustrated construction may be made without departing from the spirit of the invention.

We claim:

1. A method of installing a mooring system in newly constructed vessels and retrofitting into existing vessels, said vessels having unitary bow and stern sections comprising:

installing a vertical well extending from the deck of the vessel to the bottom plates of the vessel, the ratio of the opening of the well to the width of the deck adjacent said well being in the range of about 1:5 to 1:10;

connecting a lower bearing ring to the underside of said bottom plates said lower bearing ring circumscribing said well;

supporting a lower turret unit substantially within said lower bearing ring, said lower turret unit having an annular shape with a larger cross-sectional area, in a plane perpendicular to the longitudinal axis of said well, than said well;

placing a middle turret unit substantially within said well;

connecting said middle turret unit to said lower turret unit;

connecting an upper bearing ring to the top of the deck said upperbearing ring circumscribing said well; and connecting an upper turret unit to said middle turret unit, said upper turret unit having an annular shape with a larger cross-sectional area, in a plane perpendicular to the longitudinal axis of said well, than said well, said upper turret unit supported and guided by said upper bearing ring, whereupon the assembly of said upper, middle, and lower turret units is supported and guided by said interaction between said upper bearing ring and said upper turret unit, and said assembly is further guided by said lower bearing ring, for continuous mooring of the entire vessel in seas having wave heights which could be as great as ninety to one-hundred feet.

2. The method of claim 1 wherein installation of said lower bearing ring further includes the step of:

mounting a lower roller assembly on said lower turret unit in operative engagement with an arcuate surface of said lower bearing ring for resisting the component of forces exerted on said lower turret unit in a direction substantially perpendicular to the longitudinal axis of said well.

3. The method of claim 2 further including the step of:

resiliently mounting said lower roller assembly to said lower turret unit.

4. The method of claim 2 wherein the step of mounting the lower roller assembly further includes the step of:

resiliently mounting rollers circumferentially spaced on the outer surface of said lower turret unit.

5. The method of claim 4 wherein connecting said upper bearing ring further includes the steps of:

installing a roller support structure, with individual pillars disposed at circumferentially spaced intervals from each other, each pillar having a substantially vertical and horizontal bearing surface, said roller support structure being installed onto said deck after connecting said upper turret unit to said middle turret unit.

6. The method of claim 5 wherein connecting said upper bearing ring further includes the step of:

individually resiliently mounting thrust rollers at spaced intervals to a circular structural support member connected to said deck around said well for contact with said upper turret unit for transmitting loads exerted on said upper turret unit in a direction from said deck to said bottom plates of said vessel and substantially parallel to the longitudinal axis of said well.

7. A method of installing a mooring system in newly constructed vessels and retrofitting into existing vessels, said vessels having unitary bow and stern sections comprising:

installing a vertical well extending from the deck of the vessel to the bottom plates of the vessel, the ratio of the opening of the well to the width of the deck adjacent said well being in the range of about 1:5 to 1:10;

connecting a lower bearing ring to the underside of said bottom plates said lower bearing ring circumscribing said well;

supporting a lower turret unit substantially within said lower bearing ring, said lower turret unit having an annular shape with a larger cross-sectional area, in a plane perpedicular to the longitudinal axis of said well, than said well;

placing a middle turret unit substantially within said well;

connecting said middle turret unit to said lower turret unit;

connecting an upper bearing ring to the top of the deck, said upper bearing ring circumscribing said well;

connecting an upper turret unit to said middle turret unit, said upper turret unit having an annular shape with a larger cross-sectional area, in a plane perpendicular to the longitudinal axis of said well, than said well, said upper turret unit supported and guided by said upper bearing ring, whereupon the assembly of said upper, middle, and lower turret units is supported and guided by said interaction between said upper bearing ring and said upper turret unit, and said assembly is further guided by said lower bearing ring, for continuous mooring of the entire vessel in seas having wave heights which could be as great as ninety to one hundred feet;

mounting a lower roller assembly on said lower turret unit in operative engagement with an arcuate surface of said lower bearing ring for resisting the component of forces exerted on said lower turret unit in a direction substantially perpendicular to the longitudinal axis of said well;

resilently mounting rollers circumferentially spaced on the outer surface of said lower turret unit;

installing a roller support structure with individual pillars disposed at circumferentially spaced intervals from each other, each pillar having a substantially vertical and horizontal bearing surface, said roller support structure being installed onto said deck after connecting said upper turret unit to said middle turret unit;

individually resiliently mounting thrust rollers at spaced intervals to a circular structural support member connected to said deck around said well for contact with said upper turret unit for transmitting loads on said upper turret unit in a direction from said deck to said bottom plates of said vessel and substantially parallel to the longitudinal axis of said well;

resilently mounting uplift rollers to each of said horizontal bearing surface of said pillars, said uplift rollers in contact with said upper turret unit for resisting forces on said upper turret unit in a direction extending from said bottom plates of said vessel to said deck, substantially parallel to the longitudinal axis of said well; and resiliently mounting a lateral roller to each vertical bearing surface on each of said pillars, each such roller in contact with said upper turret unit and resisting components of forces exerted on said upper turret unit in a direction prependicular to the longitudinal axis of said well.

8. The method of claim 7 further including:

placing said uplift rollers located above said upper turret unit, in the same substantially vertical plane as a corresponding pair of thrust rollers located below said upper turret unit.

9. The method of claim 7 further includes the steps of:

installing a plurality of chain pipes in said lower, middle, and upper turret units extending substantially in a direction parallel to the longitudinal axis of said well;

installing at least one riser pipe substantially parallel to said chain pipes, said riser pipe extending from said upper turret unit to said lower turret unit; and wherein the step of connecting said upper turret unit further includes the step of:

installing a plurality of chain drives on said upper turret unit each said chain drive adapted to pay out and reel in a chain through one of said chain pipes for securing the assembly of said upper, middle, and lower turret units to the subsea floor while allowing the vessel to rotate about said upper, middle and lower turret units.

10. The method of claim 9 further including the step of:

securing a swivel joint onto said upper turret unit said swivel joint in fluid communication with said riser pipe.

11. A vessel mooring system for newly constructed vessels and for retrofitting on existing vessels, said vessels having a unitary bow and stern section and having a deck, bottom plates, and a well extending substantially vertically from said deck to said bottom plates below the vessel's water line comprising:

lower bearing means circumscribing said well and extending below said bottom plates, said lower bearing means connected to said bottom plates of said vessel;

a lower turret unit rotatably mounted to said lower bearing means below said bottom plates, said lower turret unit having an annular shape with a larger cross-sectional area in a plane substantially perpendicular to the longitudinal axis of said well, than said well;

a middle turret unit connected to top of said lower turret unit and disposed substantially within said well, said middle turret unit having a substantially smaller cross-sectional area than the cross-sectional area of said lower turret unit in a plane perpendicular to the longitudinal axis of said well;

an upper turret unit connected to said middle turret unit and disposed substantially above said deck of said vessel, said upper turret unit having an annular shape with a larger cross-section area in a plane perpendicular to the longitudinal axis of said well, than said well;

the ratio of the opening of said well to the width of the deck adjacent said well being in the range of about 1:5 to 1:10;

mooring means extending from said upper turret unit through said middle and lower turret units for continuously mooring said entire vessel to the bottom of a body of water in seas having wave heights which could be as great as ninety to one-hundred feet; and upper bearing means mounted to the top of said deck circumscribing said well for supporting and guiding above said deck the connected assembly of said upper, middle, and lower turret units in resisting forces imposed on said assembly by said mooring means.

12. The vessel mooring system of claim 11 wherein said upper bearing means further includes:

thrust rollers individually resiliently mounted to said deck and spaced at fixed intervals for contact with said upper turret unit for supporting the weight of said upper, middle and lower turret units and resisting forces exerted by said mooring means directed toward the bottom of the body of water in a direction substantially parallel to the longitudinal axis of said well.

13. The vessel mooring system of claim 12 wherein said upper bearing means further includes:

a plurality of bearing support pillars connected to said deck each pillar adjacent one of said individual resiliently mounted thrust rollers, each of said pillars having a vertical and horizontal bearing mounting surface;

resiliently mounted uplift rollers on at least one of said horizontal bearing mounting surface of each of said pillars, said uplift rollers in contact with said upper turret unit to resist uplift forces exerted on said lower, middle and upper turret units in a direction substantially parallel to the longitudinal axis of said well; and resiliently mounted lateral rollers on at least one of each vertical bearing surface of each of said pillars in contact with said upper turret unit for resisting forces exerted by said mooring means on said upper turret unit in a direction substantially perpendicular to the longitudinal axis of said well.

14. A vessel mooring system for newly constructed vessels and for retrofitting on existing vessels, said vessels having a unitary bow and stern section and having a deck, bottom plates, and a well extending substantially vertically from said deck to said bottom plates below the vessels's water line comprising:

lower bearing means circumscribing said well and extending below said bottom plates, said lower bearing means connected to said bottom plates of said vessel;

a lower turret unit rotatably mounted to said lower bearing means below said bottom plates, said lower turret unit having an annular shape with a larger cross-sectional area in a plane substantially perpendicular to the longitudinal axis of said well, than said well;

a middle turret unit connected to the top of said lower turret unit and disposed substantially within said well, said middle turret unit having a substantially smaller cross-sectional area than the cross-sectional area of said lower turret unit in a plane perpendicular to the longitudinal axis of said well;

an upper turret unit connected to said middle turret unit and disposed substantially above said deck of said vessel, said upper turret unit having an annular shape with a larger cross-sectional area in a plane perpendicular to the longitudinal axis of said well, than said well;

the ratio of the opening of said well to the width of the deck adjacent said well being in the range of about 1:5 to 1:10;

mooring means extending from said upper turret unit through said middle and lower turret units for continuously mooring said entire vessel to the bottom of a body of water in seas having wave heights which could be as great as ninetly to one hundred feet;

upper bearing means mounted to the top of said deck circumscribing said well for supporting and guiding above said deck the connected assembly of said upper, middle, and lower turret units in resisting forces imposed on said assembly by said mooring means;

said upper bearing means further includes:

thrust rollers individually resiliently mounted to said deck and spaced at fixed intervals for contact with said upper turret unit for supporting the weight of said upper, middle and lower turret units and resisting forces exerted by said mooring means directed toward the bottom of the body of water in a direction substantially parallel to the longitudinal axis of said well;

said upper bearing means further includes:

a plurality of bearing support pillars connected to said deck each pillar adjacent one of said individual resiliently mounted thrust rollers, each of said pillars having a vertical and horizontal bearing mounting surface;

resiliently mounted uplift rollers on at least one of said horizontal bearing mounting surface of each of said pillars, said uplift rollers in contact with said upper turret unit to resist uplift forces exerted on said lower, middle and upper turret units in a direction substantially parallel to the longitudinal axis of said well;

resiliently mounted lateral rollers on at least one of each vertical bearing surface of each of said pillars in contact with said upper turret unit for resisting forces exerted by said mooring means on said upper turret unit in a direction substantially perpendicular to the longitudinal axis of said well;

said lower bearing means further includes:

resiliently mounted rollers at spaced intervals on the outer periphery of said lower turret unit; and an arcuate bearing surface connected adjacent to said bottom plates in contact with said rollers on said lower turret unit for resisting lateral forces imposed by said mooring means on said lower turret unit in a direction perepedicular to the longitudinal axis of said well.

15. The mooring system of claim 14 wherein said mooring means further includes:

a plurality of chain lockers mounted to said upper turret unit;

a plurality of chain pipes extending from said upper turret unit to said lower turret unit;

a plurality of mooring chains one chain extending from each chain locker through one of said pipes and adapted to be connected to a fixed point adjacent the bottom of a body of water.

16. The mooring system of claim 15 further including:

at least one riser pipe extending from said lower to said upper turret unit; and a swivel joint connected to said upper turret unit and in fluid communication with said riser;

whereupon when the vessel rotates about said upper, middle and lower turret units when said chains are secured near the bottom of the body of water, said swivel joint permits fluid connection between said deck and said riser.

17. The mooring system of claim 14 wherein said lower bearing means further includes:

an annular frame connected to and extending below said bottom plates defining an arcuate bearing surface thereon.

* * * * *